United States Patent [19]

Stoesser et al.

[11] Patent Number: 4,603,812

[45] **Date of Patent: * Aug. 5, 1986**

[54] FOAM-GENERATING PUMP SPRAYER

[75] Inventors: Paul R. Stoesser; John E. Cuzic, both of Midland; John W. McLaren, Beaverton, all of Mich.

[73] Assignee: The Dow Chemical Company, Midland, Mich.

[ * ] Notice: The portion of the term of this patent subsequent to Aug. 7, 2001 has been disclaimed.

[21] Appl. No.: 612,196

[22] Filed: May 21, 1984

Related U.S. Application Data

[63] Continuation of Ser. No. 301,797, Sep. 14, 1981, Pat. No. 4,463,905, which is a continuation-in-part of Ser. No. 919,595, Jun. 27, 1978, abandoned.

[51] Int. Cl.[4] ..... B05B 1/26; B05B 11/00

[52] U.S. Cl. ..... 239/329; 239/397; 239/428.5; 261/DIG. 26; 261/DIG. 75

[58] Field of Search ..... 239/329, 331, 333, 343, 239/397, 428.5; 261/DIG. 26, DIG. 75; 169/15; 222/383; 252/359 E

[56] References Cited

U.S. PATENT DOCUMENTS

| | | | |
|---|---|---|---|
| 2,345,812 | 4/1944 | Harriman et al. . | |
| 2,492,037 | 12/1949 | Freeman et al. | 261/DIG. 26 |
| 2,645,292 | 7/1953 | Williams | 239/428.5 X |
| 2,651,546 | 9/1953 | Palm | 239/343 |
| 2,826,399 | 3/1958 | Eriksson | 239/428.5 |
| 2,965,309 | 12/1960 | Parrott . | |
| 3,388,868 | 6/1968 | Watson et al. . | |
| 3,446,285 | 5/1969 | Hout . | |
| 3,547,200 | 12/1970 | Hout . | |
| 3,572,590 | 3/1971 | Malone . | |
| 3,946,947 | 3/1976 | Schneider | 239/428.5 X |
| 4,013,228 | 3/1977 | Schneider . | |
| 4,153,203 | 5/1979 | Tada . | |
| 4,219,159 | 8/1980 | Wesner | 239/428.5 X |

FOREIGN PATENT DOCUMENTS

| | | | |
|---|---|---|---|
| 237790 | 5/1962 | Austria . | |
| 1069365 | 7/1954 | France . | |
| 37-6564 | 4/1962 | Japan . | |
| 50-58310 | 5/1975 | Japan . | |
| 50-78638 | 7/1975 | Japan . | |
| 50-152594 | 12/1975 | Japan . | |
| 18515 | of 1908 | United Kingdom | 239/397 |
| 1120323 | 7/1968 | United Kingdom . | |
| 1120324 | 7/1968 | United Kingdom . | |
| 1135929 | 12/1968 | United Kingdom . | |
| 1344417 | 1/1974 | United Kingdom . | |
| 1468249 | 3/1977 | United Kingdom . | |

OTHER PUBLICATIONS

AFA 5912BA Foamin Attachment Manufactured by the AFA Corporation of Florida.

*Primary Examiner*—Andres Kashnikow
*Attorney, Agent, or Firm*—Burke M. Halldorson

[57] ABSTRACT

A hand-held apparatus for spraying foam comprises (a) a manually-operated dispensing pump capable of receiving a foamable liquid from a suitable container and ejecting it into the atmosphere through an atomizing nozzle, thereby forming a spray from such liquid and projecting it outwardly from the nozzle in a predetermined spray pattern, and (b) foam-forming device including an air inlet and a screen retained in the path of the spray. The screen can be retained in a foam-forming position by suitable means such as a housing operatively associated with the dispensing pump. Substantially all the spray passes through the foam-forming device without contact except by the screen, thereby generating foam with little modification of the predetermined spray pattern.

17 Claims, 5 Drawing Figures

FOAM-GENERATING PUMP SPRAYER

CROSS REFERENCE TO RELATED APPLICATIONS

This application is a continuation of application Ser. No. 301,797, filed Sept. 14, 1981 now U.S. Pat. No. 4,463,905, which is a continuation-in-part of application Ser. No. 919,595, filed June 27, 1978 now abandoned.

BACKGROUND OF THE INVENTION

The present invention relates to foam generating and dispensing devices and, more particularly, to manually-operated atomizing dispensers having the capacity to spray a foamable liquid as a foam.

Foam generating and dispensing devices are well known in the art, as demonstrated by the numerous patents and disclosures that have been published on this subject and by the vast array of foam product dispensers currently on the market. Recent trends in the packaging and merchandising of consumer goods, such as cleaning and waxing products, toiletries and cosmetics, foodstuffs, and the like, have evidenced a growing demand for such devices, especially those which can be held in the hand and readily operated by the household user.

The demand for these devices has heretofore been satisfied almost exclusively by the disposable, self-contained aerosol dispensers, due to their convenience and adaptability to a wide variety of products and foaming conditions. However, the continued use of such self-contained aerosol dispensers is presently being reevaluated, due in part to recently espoused environmental concern over the effect of some of the propellants used therein and in part to changing economic conditions. Accordingly, workers in the art have embarked upon a search for an acceptable replacement for the aerosol foam dispensers.

Generally, those replacement devices which have been proposed are of the type which include a collapsible bottle and a foam-forming cap assembly. The foam-forming cap assembly typically includes a homogenizing element of sponge-like material providing minute tortuous passages in which a flow of foamable liquid and air from the container is mixed to provide foam. Exemplary devices of this type are described in U.S. Pat. No. 3,985,271; U.S. Pat. No. 3,973,701; U.S. Pat. No. 3,937,364; and U.S. Pat No. 3,572,590. In such devices, the mixture of air and liquid loses considerable velocity as it passes through the homogenizing element. Consequently, such devices undesirably have only limited "reach", i.e., they require the user to dispense the foam in near proximity to the surface upon which the foam will be deposited. Furthermore, because the user must apply his efforts to expel both liquid and air simultaneously, appreciable energy is wasted in forming and dispensing the foam. Still further, such devices are uneconomical inasmuch as they require that the bottle be only partially filled with a foamable liquid so that the necessary internal air supply is available for foam formation.

Consequently, attempts have been made to convert a conventional manually-operated atomizing dispenser (or "pump sprayer" as they are often called) to a foam-forming device, thereby overcoming some of the disadvantages of the "collapsible bottle" foamers. Specifically, it has been appreciated that (a) a pump sprayer is highly efficient, i.e., the user's efforts are directed to expelling only liquid, thereby minimizing the labor involved in its operation, and (b) it has considerable "reach", i.e., the liquid can be projected over a considerable distance.

One means of converting a pump sprayer to a foam sprayer which has been suggested is a foam-generating nozzle attached to the spray outlet end of the pump sprayer. An example of such a nozzle is described in U.S. Pat. No. 3,946,947 (Schneider). Schneider utilizes an elongated, pressure-reducing passageway in which air is mixed with a foamable liquid. The foam is formed by the air/liquid mixture striking the surfaces of the passageway, i.e., turbulent flow.

The commercially acceptable quality of foam which is desired by Schneider and others is an aerosol-type foam, i.e., a foam which stays or hangs on a vertical surface to optimize contact between the foam and the surface. The initial foam pattern on the surface is maintained for several seconds without substantial drip or run.

However, the Schneider means of achieving this quality foam has several limitations to marketplace acceptance: a relatively high cost, complex nozzle attachment, reduced size of spray pattern produced, and increased user effort required to operate the pump sprayer because of the added resistance/pressure of generating the foam in the nozzle attachment.

Accordingly, it is an object of the present invention to provide a hand-held, manually-operated foam generating and dispensing apparatus which requires only minimal user effort, which has considerable reach without reducing the spray pattern, which can spray a foam of commercially acceptable quality, and which can be economically produced by conventional fabrication techniques.

More specifically, it is an object of this invention to provide a pump sprayer or manually-operated atomizing dispenser having the capacity to spray a foamable liquid as a foam.

SUMMARY OF THE INVENTION

The present invention provides a hand-held, foam-spraying apparatus comprising (a) a manually-operated dispensing pump, including an atomizing nozzle, for drawing a foamable liquid from a container and ejecting it into the atmosphere through the atomizing nozzle, thereby forming a spray from such liquid and projecting the spray in a predetermined pattern outwardly from the atomizing nozzle, and (b) foam-forming means operatively associated with the dispensing pump for producing foam from the spray without substantially modifying the predetermined spray pattern. The foam-forming means includes (1) a screen retained in the path of the spray and (2) means for introducing air into the spray so that the spray is permitted to foam upon contact with the screen. The foam-forming means is constructed to permit substantially all of the spray to pass therethrough without contact except by the screen. The apparatus of the present invention is unique in permitting the original spray pattern and direction to be maintained.

The foam produced by the apparatus of the present invention comprises a liquid matrix containing discrete air bubbles. This is in direct contrast to a so-called fog spray or fog foam which is discrete air bubbles in a continuous air phase.

The foam produced by the present apparatus is such that it is retained on a vertical surface essentially drip or run-free for at least several seconds to allow maximum interaction between the liquid/foam and the surface, that is, it is a stable foam.

The present apparatus generates foam on the surface of the screen using air external to the dispensing pump. Consequently, the user's labor is minimized since the amount of liquid expelled in the form of a foam is directly proportional to the effort contributed, there being no wasted energy due to the compression of air as in the "collapsible bottle" foamers.

Also, because the present apparatus does not require an elongated, narrowing nozzle to produce the foam, there is no additional user effort needed to generate the foam. The foam is formed on the screen and is pushed off the screen to the target surface by the next layer/-wave of liquid being sprayed onto the screen. The screen does not serve as a barrier which holds up the foam in the space between the orifice of the nozzle and the screen surface.

Additionally, minimal velocity is lost by the spray as it is converted to foam in the present apparatus, since substantially all the spray passes through the foam-forming means without contact except by the surface of the screen. Accordingly, the reach of the present foamer is considerably increased compared to the "collapsible bottle" foamers.

Still further, the present apparatus is very economical to produce since, in some instances, it can be readily constructed with only minimal modification of a pre-existing pump sprayer.

Because the present apparatus provides a foam of commercially acceptable quality, i.e., it is relatively dry and stable and has little tendency to drip when deposited on a vertical surface, it is eminently suited for spray-foaming household cleaners and the like.

DETAILED DESCRIPTION OF THE INVENTION

Figure 1:
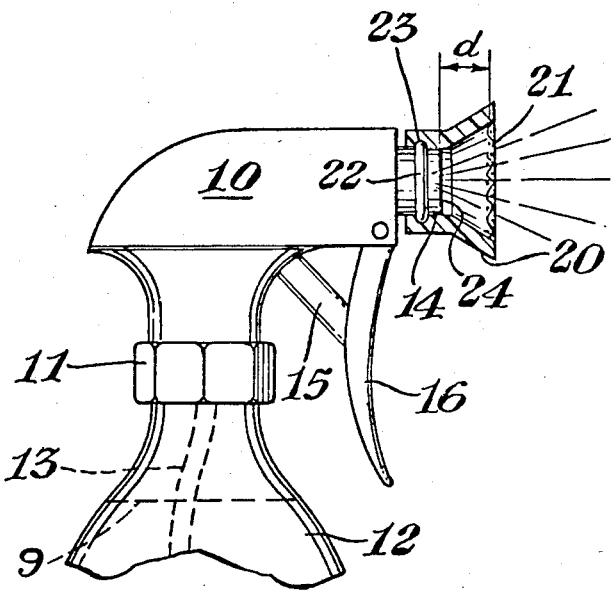
FIG. 1 is a side elevation view, showing the foam-forming means in section, of a foam-spraying apparatus in accordance with the present invention connected to a partial container.
Figure 2:
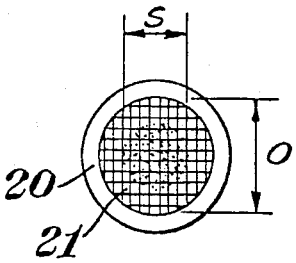
FIG. 2 is a frontal elevation view of the foam-forming means of FIG. 1.

Referring to the drawings, and more particularly to FIGS. 1 and 2, a manually-operated dispensing pump 10 is detachably connected by a conventional threaded coupling 11 to a container 12 for receiving a foamable liquid 9 contained within container 12. It is not a requirement of this invention that the dispensing pump be connected to the container, though such is desirable to enhance mobility. Generally, a conventional hand-held dispenser/container combination, as such is currently marketed for household use, is preferred. Regardless of the particular form chosen, it is understood that communication will be provided between the dispensing pump and the foamable liquid, e.g., through a dip tube 13 (shown in phantom), so that the dispensing pump is able to draw liquid from the container.

As used herein, the term "foamable liquid" is meant to include any liquid having the capacity to form a foam when dispensed by the foam-spraying apparatus of the present invention. Generally, such liquids will exhibit the following properties: surface tension in the range of about 20 to 45 dyne/cm, preferably about 25 to 35 dyne/cm; density in the range of about 0.8 to 1.2 g/cc, preferably about 0.98 to 1.05 g/cc; and viscosity in the range of about 0.9 to 1.7 centistokes, preferably about 1.1 to 1.4 centistokes.

The dispensing pump may generally be of any conventional construction, so long as it includes an atomizing nozzle 14. The term "atomizing nozzle" as used herein is intended to be generic to a mechanism for providing a fine spray of liquid through a single orifice, which mechanism will be readily appreciated by workers in the art of pump sprayer design. Such dispensing pumps are provided with a compression mechanism, e.g., a piston 15 and an actuator 16, to force the liquid received from the container through the atomizing nozzle with sufficient velocity to form the spray. Suitable dispensing pumps will preferably provide a spray having a velocity in the range of about 15 to 21 m/s through an orifice having a diameter in the range of about 0.3 to 0.65 mm and a land length in the range of about 0.25 to 0.6 mm. Exemplary dispensing pumps which may be used in the present invention include the AFA 7510 sprayer (manufactured by The AFA Corporation) and the Canyon CS sprayer (manufactured by Canyon Corporation).

A foam-forming means, including a bell-shaped housing 20 and a screen 21, is operatively associated with the dispensing pump by a snap-fit mechanism consisting of a peripheral detent 22 which depends from the atomizing nozzle and a complimentary annular groove 23 defined by the inner surface of the housing 20. The housing 20 functions to retain the screen 21 in the path of the spray at a distance d from the atomizing nozzle, i.e., the distance from the point at which the spray is ejected from the dispensing pump into the atmosphere (which point will typically coincide with the location of the nozzle face 24). In order to generate a high quality foam, distance d will generally be in the range of about 0.8 to 4 mm, preferably in the range of about 2 to 3 mm. Furthermore, the screen size will generally be in the range of about 60 to 200 mesh (U.S. Sieve Series), preferably in the range of about 100 to 180 mesh. Screens having a smaller mesh size than that indicated will severely reduce spray velocity and cause excessive dribbling, whereas screens having a large mesh size will permit spray to pass therethrough without sufficient foaming. The screen can be made of any material which is inert to the foamable liquid which will be dispensed. Because of their low cost and characteristically flat surface conformations, plastic screens, such as those made from polyethylene or polypropylene, are preferred. Furthermore, such plastic screens are eminently suited for sonic or electronic welding, thus providing a convenient method of attaching the screen to housing 20, should the housing be constructed of a similar plastic material. Other methods of attachment, such as by a suitable adhesive or press-fit mechanism, can also be used.

One method of attaching the screen 21 to a polymer housing 20 comprises placing the screen over the opening in the housing and bringing into contact with the screen periphery a heated annular die, which causes the polymer of the housing opposite the screen periphery to soften or melt. By slight pressure on the die the screen is embedded in the softened/melted polymer. The screen is held in place when the polymer hardens after the die is disengaged from the screen.

Figure 3:
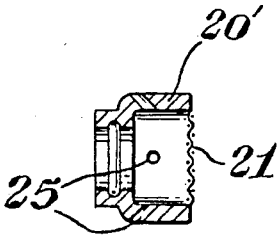
FIG. 3 is a sectional side elevation view of another embodiment of a foam-forming means in accordance with the present invention.

The foam-forming means also includes means for introducing air into the spray so that the spray is permitted to foam upon contact with the screen. One method of accomplishing this is to construct housing 20 so that the diameter of the opening therein is larger than the diameter of the spray pattern at the point which it intercepts the screen, whereby air is permitted to enter the foam-forming means from the front. This will be better understood by referring to FIG. 2, which shows the diameter s of the spray pattern as it intercepts the screen 21 (depicted by shading) and the diameter o of the opening of housing 20. Another method is exemplified by FIG. 3, wherein housing 20' defines passageways 25 which permit air to flow into the spray through the wall of the foam-forming means. Either of these methods, or a combination thereof, may be used. In either method, however, the foam-forming means should be constructed so as to provide the proper amount of air for good foam formation. Specifically, if too little air is available, some of the spray will pass through the screen without foaming, thereby resulting in an undesirably wet foam being ejected from the foam-spraying apparatus.

It is a requirement of the foam-forming means of the present invention that substantially all the spray pass therethrough without contacting any surface except the surface of the screen. Mechanical breakup of the spray, such as by impinging upon the walls of housing 20, should be minimized, since such will cause the reduction of spray velocity and result in undesirable dribbling from the foam-spraying apparatus.

Figure 4:
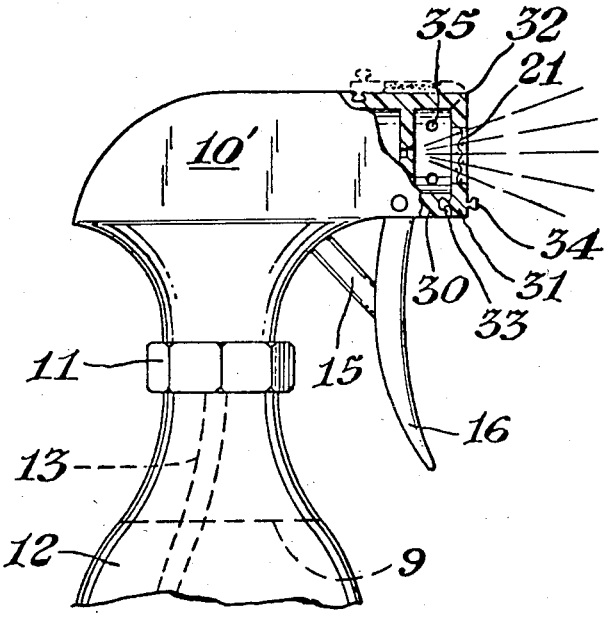
FIG. 4 is a side elevation view, partially in section, of another embodiment of a foam-spraying apparatus in accordance with the present invention connected to a partial container.
Figure 5:
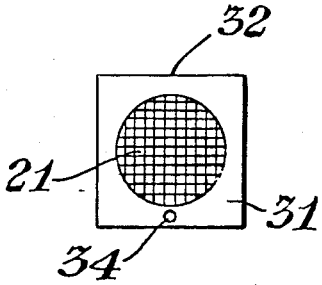
FIG. 5 is a frontal elevation view of the foam-forming means of FIG. 4.

It will be appreciated that the foam-forming means of the present invention is capable of numerous embodiments. For example, it may be constructed so as to be detachable from the dispensing pump, as exemplified by FIGS. 1–3, or it may be permanently integrated with the dispensing pump, as exemplified by FIGS. 4–5. In FIG. 4, the foam-forming means comprises an integral box-like member 30, which protrudes outwardly from a dispensing pump 10' adjacent to the atomizing nozzle. The box-like member includes a flap 31, retaining a screen 21, and defines suitable air passages 35 at a position rearward of the flap. Flap 31 is connected to the box-like member by a hinge 32 so that the flap can be pivoted 270° from a foam-generating position, wherein the screen is retained in the path of the spray, to a position where no foam is generated (shown in phantom). Suitable locking pins 33 and 34 snap-fit into mating receptacles defined by the box-like member 30 and the upper surface of the dispensing pump 10', respectively, to enable the user to lock flap 31 in the desired operating position.

The type of dispensing pump to be used in the present foam-spraying apparatus is not critical. For example, the dispensing pump can be a finger-actuated, vertically-oriented mechanism as well as the hand-actuated, horizontally-oriented mechanism like that shown in FIGS. 1 and 4. Additionally, the form of the screen can be varied within the scope of the functional requirements suggested earlier. For example, the screen may be arcuate in cross-section, e.g., protruding away from the atomizing nozzle, and the openings of the screen can be of any desired configuration, i.e., the openings need not be square.

Other embodiments of a foam-spraying apparatus in accordance with the present invention may be made without departing from the invention in its broader aspects.

The following specific example illustrates the invention but is not to be taken as limiting its scope.

EXAMPLE

In order to demonstrate the effectiveness of the foam-forming apparatus of the present invention, experiments were performed by testing two commercially available dispensing pumps, i.e., the AFA 7510 sprayer and the Canyon CS sprayer, with and without the foam-forming means depicted in FIGS. 1 and 2. The foam-forming means included a 100 mesh nylon screen spaced a distance d of about 3 to 4 mm from the atomizing nozzle and had an opening o of about 10 mm.

For comparison, an AFA 5910 sprayer was tested with and without an AFA 5912BA foaming attachment. The AFA 5912BA attachment is a commercial embodiment of the nozzle described in U.S. Pat. No. 3,946,947.

A foamable liquid cleaner having a surface tension of 31.2 dyne/cm, density of 1.02 g/cc, and viscosity of 1.37 centistokes was used in all tests.

The results of these experiments are shown in Table 1. It can be seen that the AFA 5912BA foaming attachment severely modified the predetermined spray pattern and rendered the dispensing pump relatively hard to operate. These limitations are due to the manner in which the foam is formed, i.e., through the use of an elongated, multichambered, narrow nose nozzle attachment requiring turbulent flow of the air/liquid mixture.

In contrast, the foam-forming means of the present invention did not substantially modify the predetermined spray pattern nor did it substantially affect the amount of effort required to operate the dispensing pump. These additional advantages are due to the entirely different means of foam formation —foam is formed on the screen and pushed off the screen to the target without further hinderance.

In addition, the present foam-forming means was able to produce a very good quality foam—much like that produced by a typical aerosol dispenser.

TABLE 1

| Sprayer | Orifice Diameter (mm) | Foam Attachment | Spray Area[1] (in × in) | Ease of Operation | Foam Quality |
|---|---|---|---|---|---|
| Control | | | | | |
| AFA 7510 | 0.56 | None | 5.5 × 6 | Moderate | None |
| Canyon CS | 0.64 | None | 6 × 7 | Easy | None |
| AFA 5910 | 0.56 | None | 7 × 8 | Moderate | None |
| The Invention | | | | | |
| AFA 7510 | 0.56 | Yes | 5 × 5.5 | Moderate | Scattered, Slowly Runs |
| Canyon CS | 0.64 | Yes | 5 × 6.5 | Easy | Scattered, |

TABLE 1-continued

| Sprayer | Orifice Diameter (mm) | Foam Attachment | Spray Area[1] (in × in) | Ease of Operation | Foam Quality |
|---|---|---|---|---|---|
| | | | | | Hardly Runs |
| For Comparison | | | | | |
| AFA 5910 | —[2] | AFA 5912BA | 3.5 × 2.5 | Hard | Thick Buildup Slowly Runs |

Notes:
[1]Measured on a target located at a distance of about 7 in. from the sprayer.
[2]Not measured.

The inventors hereby state their intent to rely on the Doctrine of Equivalents to determine and assess the reasonably fair scope of their invention as pertains to any apparatus not materially departing from but outside the literal scope of the invention as set out in the following claims.

What is claimed is:

1. A hand-held, foam-spraying apparatus for producing a foam comprising a liquid matrix containing discrete air bubbles and comprising in cooperative combination:

(a) a trigger-operated hand dispensing pump, including an atomizing nozzle, for drawing a foamable liquid from a container and ejecting it into the atmosphere through the atomizing nozzle, thereby forming a spray from such liquid and projecting the spray in a predetermined pattern outwardly from the atomizing nozzle, and (b) foam-forming means operatively associated with the dispensing pump for producing foam from the spray using air external to the apparatus and without substantially modifying the predetermined spray pattern, the foam-forming means consisting essentially of (1) a screen having a size generally in the range of about 60 to 200 mesh U.S. Sieve Series and being retained in the path of the spray a distance from the atomizing nozzle which is suitable for producing the result of a relatively dry foam, and (2) means for introducing air into the spray so that the spray is permitted to foam upon contact with the screen; the foam-forming means permitting the passage of substantially all the spray therethrough without contact except by the screen and being effective for generating a relatively dry foam having reduced tendency to drip when deposited on a vertical surface.

2. An apparatus according to claim 1 wherein the foam-forming means is joined to the dispensing pump and positionable between a first position for producing foam and a second position for permitting spray to be ejected without producing foam.

3. An apparatus according to claim 1 wherein the screen has a size in the range of about 100 to 180 mesh U.S. Sieve Series.

4. An apparatus according to claim 1 wherein the screen is spaced a distance of about 0.8 to about 4 mm from the atomizing nozzle.

5. An apparatus according to any of the preceding claims 1–4 having as the dispensing pump, a trigger-operated pump which develops upon hand actuation a spray having a velocity of between about 15 to 21 m/s through an orifice having a diameter in the range of between about 0.3 to 0.65 mm.

6. An apparatus according to claim 1 including in association with the hand dispensing pump, a container having a foamable liquid therewithin.

7. An apparatus according to claim 6 wherein the liquid is a foamable liquid cleaner.

8. An apparatus according to any of the preceding claims 1–4, 6 or 7 wherein the apparatus is effective to produce a foam of a quality which is generally similar to that produced by a typical aerosol foam dispenser.

9. A hand-held, foam-spraying apparatus for producing a foam comprising a liquid matrix containing discrete air bubbles and comprising in cooperative combination:

(a) a trigger-operated hand dispensing pump, including an atomizing nozzle, for drawing a foamable liquid from a container and ejecting it into the atmosphere through the atomizing nozzle, thereby forming a spray from such liquid and projecting the spray in a predetermined pattern outwardly from the atomizing nozzle, and (b) foam-forming means operatively associated with the dispensing pump for producing foam from the spray using air external to the apparatus and without substantially modifying the predetermined spray pattern, the foam-forming means consisting essentially of (1) a screen having a size generally in the range of about 60 to 200 mesh U.S. Sieve Series and which is retained in the path of the spray, and (2) means for introducing air into the spray so that the spray is permitted to foam upon contact with the screen, said means for introducing air comprising the peripheral edge portion of the screen disposed outwardly of the spray pattern at the point it intercepts the screen whereby air is permitted to enter from the front; the foam-forming means permitting the passage of substantially all the spray therethrough without contact except by the screen and being effective for generating a relatively dry foam having reduced tendency to drip when deposited on a vertical surface.

10. An apparatus according to claim 9, wherein the foam-forming means is joined to the dispensing pump and positionable between a first position for producing foam and a second position for permitting spray to be ejected without producing foam.

11. An apparatus according to claim 9, wherein the screen has a size in the range of about 100 to 180 mesh U.S. Sieve Series.

12. An apparatus according to any one of the preceding claims 9–11 wherein the screen is spaced from the atomizing nozzle a distance not exceeding generally about 4 mm.

13. An apparatus according to claim 12 having as the dispensing pump, a trigger-operated pump which develops upon hand actuation a spray having a velocity of between about 15 to 21 m/s through an orifice having a diameter in the range of between about 0.3 to 0.65 mm.

14. An apparatus according to claim 8 including in association with the hand dispensing pump, a container having a foamable liquid therewithin.

15. An apparatus according to claim 14 wherein the liquid is a foamable liquid cleaner.

16. An apparatus according to any one of the preceding claims 6–8, 14 or 15 wherein the apparatus is effective to produce a foam of a quality which is generally similar to that produced by a typical aerosol foam dispenser.

17. An apparatus according to claim 16 wherein the screen is spaced from the atomizing nozzle a distance not exceeding generally about 4 mm.

* * * * *

UNITED STATES PATENT AND TRADEMARK OFFICE

CERTIFICATE OF CORRECTION

PATENT NO. : 4,603,812

DATED : August 5, 1986

INVENTOR(S) : Stoesser et al.

It is certified that error appears in the above-identified patent and that said Letters Patent is hereby corrected as shown below:

Column 4, line 52, please delete the word "large" and insert --larger--.

Column 7, line 12, please insert --Statement of Intent--.

Column 8, Claim 12, line 57, please delete the word "one".

Column 8, Claim 14, line 66, please delete "8" and insert --9--.

Column 9, Claim 16, line 4, please delete the word "one".

Column 9, Claim 16, line 5, please delete "6-8" and insert --9-11--.

Signed and Sealed this

Fourteenth Day of April, 1987

*Attest:*

*Attesting Officer*

DONALD J. QUIGG

*Commissioner of Patents and Trademarks*